United States Patent [19]

McCracken

[11] 4,169,619

[45] Oct. 2, 1979

[54] PORTABLE SECURITY LOCK

[76] Inventor: James H. McCracken, 1486 Moore Cir., Corona, Calif. 91720

[21] Appl. No.: 916,487

[22] Filed: Jun. 19, 1978

Related U.S. Application Data

[63] Continuation of Ser. No. 801,208, May 27, 1977, abandoned.

[51] Int. Cl.[2] ..... E05C 19/18

[52] U.S. Cl. ..... 292/290; 292/296; 292/297

[58] Field of Search ..... 70/14, 456 R, 457; 292/205, 288, 289, 290, 295, 296, 297, 298

[56] References Cited

U.S. PATENT DOCUMENTS

| | | | |
|---|---|---|---|
| 866,681 | 9/1907 | Powell | 292/290 |
| 910,431 | 1/1909 | Stoffel | 292/296 |
| 1,061,629 | 5/1913 | Parsons | 292/297 |
| 1,147,459 | 7/1915 | Stoddard | 292/296 |
| 1,176,859 | 3/1916 | Sautter | 292/298 |
| 1,290,560 | 1/1919 | Howard | 292/296 |
| 1,947,773 | 2/1934 | Haviland | 292/296 |

*Primary Examiner*—Robert L. Wolfe

*Attorney, Agent, or Firm*—M. Ralph Shaffer

[57] ABSTRACT

A portable, lightweight security lock for doors comprising an elongate movable abutment member and an elongate catch member pivotally secured thereto. The abutment member has a laterally extending abutment portion for disposition in proximity with the door surface when such door is closed; the elongate catch member has a laterally extending catch portion which is insertable into the latch socket of a door jam. In a preferred embodiment the elongate movable abutment member includes a resilient pad on its forward surface, this to accommodate tolerances and deviations thereof in actual casement and lock installations. The elongate movable abutment member and elongate catch member are provided with inter-cooperating dog and teeth means which inter-engage selectively, depending upon the door installation involved, this so that need not be present pivotal movement between the two members when the movable abutment member is to be released from engagement with the door. Upon longitudinal withdrawal, however, the abutment member is pivotal with respect to the elongate catch member so as to allow for free door opening.

4 Claims, 10 Drawing Figures

PORTABLE SECURITY LOCK

FIELD OF INVENTION

This is a continuation in part of pending patent application Ser. No. 801,208, filed May 27, 1977 and entitled "PORTABLE SECURITY LOCK," and now abandoned.

The present invention relates to door locking mechanisms and, more particularly, to a new and improved, lightweight, portable security lock for releasably retaining doors in a closed and temporarily locked condition relative to the door jam.

The invention broadly may be summarized in the following statement:

The same comprises a security lock which can be easily manipulated bo both permit the engagement of the device proximate the latch socket or equivalent structure at the jam and, subsequent to door closure, to allow for a pivoted swinging movement of an elongate movable abutment member of the device such that the same either abuts or is proximate to that surface of the door which is advanced in the direction of door opening.

Releasable means are incorporated in the security lock of the invention so that the two principal parts of the invention, namely, the elongate catch member and the elongate abutment member, can be mutually positioned such that the abutment feature inheres in the device.

DESCRIPTION OF PRIOR ART

Certain door and window securements have been devised in the past which, while relevant to the teachings of the present invention, are clearly distinguished therefrom. Certain ones of these United States patents are as follows: Nos.

| | |
|---|---|
| 383,724 | Getty |
| 665,010 | Hughes & Walker |
| 506,789 | Murray & Haynes |
| 1,717,964 | Dorion |
| 1,082,019 | Frederick |
| 2,786,705 | Stalmer |

The Getty patent teaches the necessity of a double abutment, with a forwardly and laterally extending prong being required for additional penetration of structure enclosing a door opening. The Dorion patent teaches another complex and expensive structure being laterally pivoted and adjustable relative to a main member. The Frederick patent teaches a hinge-type structure which is selectively movable into and out of alignment with the door in the direction of its opening. The Stalmer patent teaches a complex and expensive structure incorporating a hinge, with other structure brought into abutment with the door surface. The Murray and Haynes patent teaches the employment of double abutment portions with forwardly extending prongs.

None of the above patents teach the concept of the present invention in having simply two members pivotally secured together, one designed for abutment of the door, and the other designed for engagement with the latch socket or its structure, and with lock means in the form of a releasable detent or other means for releasably securing the two members such that the abutment feature is maintained for as long as necessary or desired.

No art is known which teaches the important concept, in a preferred embodiment of the invention of providing a resilient bumper pad to be associated with the forward face of the movable abutment member in the combination, with the abutment member and accompanying elongate catch member having mutually inter-cooperating means by way of a dog and teeth, for example, for temporarily securing door-closure while admitting later pivoting of the movable abutment member relative to the elongate catch member so as to allow for free door opening. The patents cited in the prosecution of the parent hereof do not teach such a concept, taken either singly or in combination. These patents include U.S. Pat. Nos: 907,301; 1,154822; 3,383,724; 116,621; 946,437; 979,167; 2,461,398 and 2,554,303.

BRIEF SUMMARY OF THE INVENTION

According to the present invention, broadly speaking, a security lock is provided which may be conveniently installed and easily removed without attachments and without scarring the existing door, jam, and associated equipment. In one embodiment, the device is designed so that the same is easily installed by selective insertion of one portion of the device into the latch socket, or in engagement with the strike plate thereat, for example; once door closure is made, the abutment member, pivoted to the prior latch socket engagement member, is pivoted forwardly so that its abutment portion is proximate the adjacent door surface. Lock means may be provided either in the form of detents, a padlock, or other means, to keep the two essential members of the device in a lock-type alignment. In a preferred embodiment of the invention the abutment member is provided with a forwardly facing resilient pad. Also, the abutment member and the elongate jam engagement member connected to the abutment member have mutually inter-engaging detent means preferably in the form of a dog and a series of ratchet-like teeth, these being used such that a forward movement of the movable abutment member against the compression resiliency of the pad will produce a selected engagement as between the dog and a tooth of the elongate catch member and the movable abutment member, this so that there is a firm securement of the door within the jam in its closed position. This engagement will not be released until the user purposeful releases the same, withdrawing the movable abutment member rearwardly so that the same may pivot at its rearmost position and thus drop downwardly, thereby permitting free door opening.

OBJECTS

Accordingly, a principal object of the present invention is to provide a security lock for doors.

A further object is to provide a security lock comprised simply of two essential members, pivoted together, one being constructed for abutment relative to a door surface, and the other being constructed for releasable insertion into the latch socket of the jam for engagement therewith, or a strike plate edge associated therewith.

A further object is to provide releasable detent means in a security lock for releasably securing portions of the same in a selected position, temporarily.

A further object is to provide means in a security lock for permitting the same to be locked, whereby to prevent inadvertent door opening from either side of the door.

A further object is to provide a security lock comprising two essential members, one with a fowardly facing resilient bumper pad, the two members cooperating in a detent dog and ratchet-teeth arrangement whereby a door may be secured in closed position and, upon withdrawal of one of the two members from the detent position, the door can be freely opened.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 2:
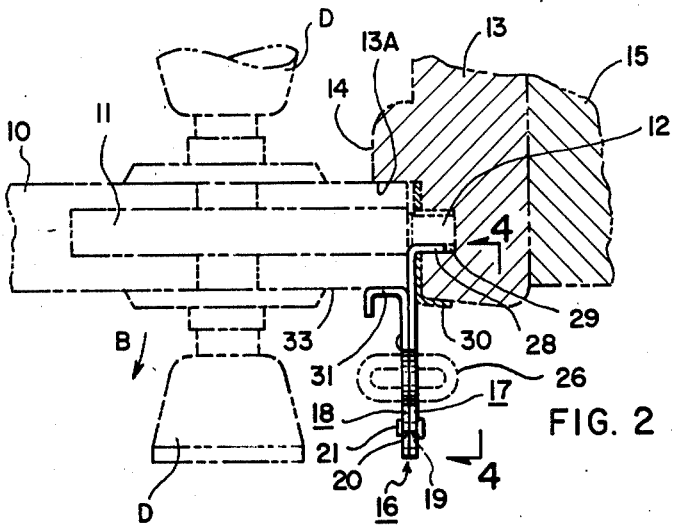
FIG. 2 is a top plan of the structure of FIG. 1, and is taken along the line 2—2 in FIG. 1.
Figure 1:
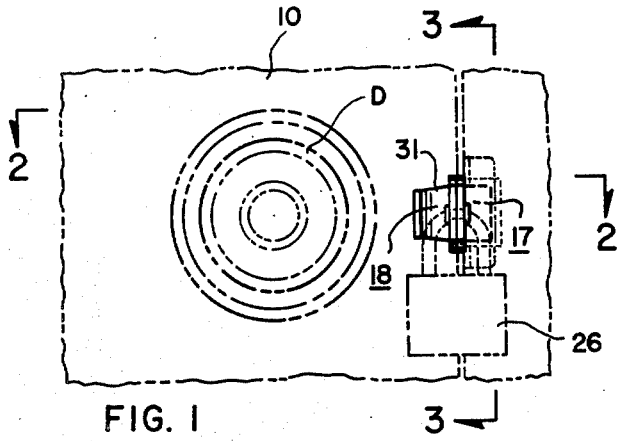
FIG. 1 is a frontal elevation of the portable security lock of the invention, the door, door jam, and padlock being shown in plantom line configuration.
Figure 3:
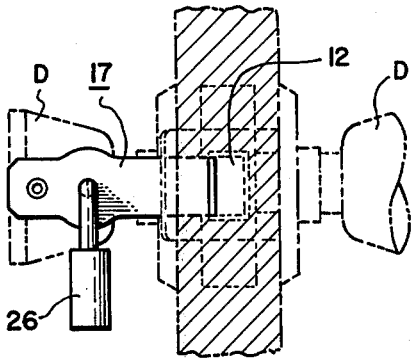
FIG. 3 is a transverse vertical section taken along the line 3—3 in FIG. 1.

In FIGS. 1-3, door 10 has the usual door knobs D and associated latching mechanism 11, set into the customarily provided door cavity, provided with latch 12. Door jam 13 forms door opening 14 and is part of wall 15. The structure as thus far described is strictly conventional. Lock member 16, a portable security lock of this invention, is formed essentially of three parts, namely, an elongate catch member 17 and a movable abutment member 18, these two being pivoted together at respective apertures 19 and 20 by rivet or other pivot means 21. Each of the elongate catch member 17 and movable abutment member 18 may have enlarged medial portions 22 and 23, both being provided with a central aperture 24, 25 which are actually aligned and which accommodates a permissibly included padlock or other type of lock 26. The lock feature is enabled when the two members 17, 18, are brought from a non-aligned configuration, see the dotted lines in FIG. 6, to a totally aligned condition as shown in the same figure.

Figure 5:
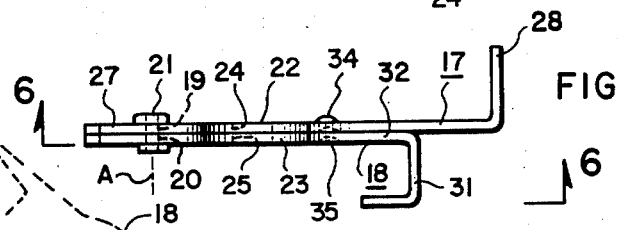
FIG. 5 is an edge view of the security lock of FIG. 4 and is taken along the line 5—5 in FIG. 4.

Elongate catch member 17, including the elongate portion 27, having employed medial portion 22, also is provided with a foot portion 28 that is oriented outwardly in the direction shown in FIG. 5. It is this foot portion that is constructed for selective insertion, see FIG. 2, into the latch socket 29 of jam 13. The latch socket is, of course, outlined by the usual strike plate 30 customarily associated with latchtype door openings.

Abutment portion 31 is or may be essentially L-configured and proceeds transversely or laterally outwardly from elongate portion 32 of movable abutment member 18.

Figure 4:
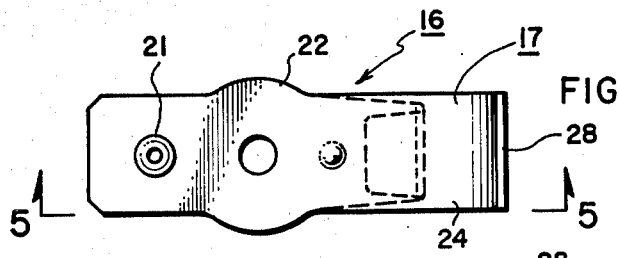
FIG. 4 is a side view of the portable lock of the invention and is taken along the line 4—4 in FIG. 2.

As to operation of the security lock herein, the pivot means 21, such as an eyelet rivet, provides for selective pivoting of movable abutment member 18 about axis A relative to elongate catch member 17, so that the abutment portion 31 may be brought into proximity, and selectively away from proximity, with the rear surface 33 of door 10. In the condition shown in FIGS. 1-5 and 7, the abutment portion 31 is brought in proximity and conceivably even in contact with the rear surface 33 of door 10, the condition wherein the user desires the door to be firmly locked in place against surface 13A of jam 13. In such condition, as to operation, the two members 17 and 18 may even be brought in alignment and locked by lock 26, although a lock need not be employed unless especially designed. Furthermore, a releasable detent can exist between the two members 17 and 18 where, for example, aligned dimples 34, 35 are punched or otherwise provided in the security lock to provide a detent-type of releasable lock as between the two members 17, 18. Such a detent will serve to keep the parts 17, 18 releasably aligned together in the manner shown in FIG. 4. When, however, the security lock is to be released so that the door can be opened, then it is a simple matter for member 18 to be raised to the dotted line condition shown in FIG. 6, whereby the door can be opened and the lock member 16 removed from the latch socket of the door jam at 29.

Figure 6:
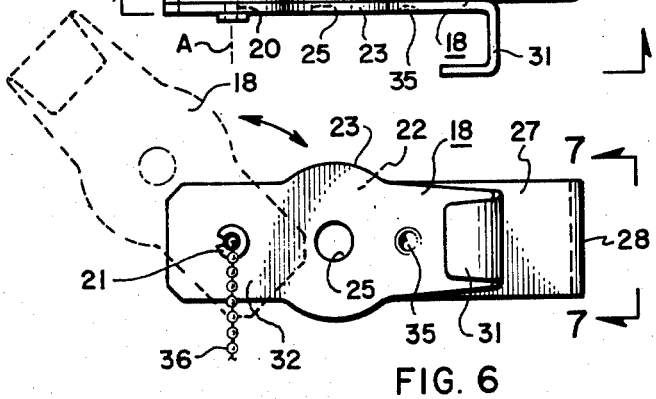
FIG. 6 is a view of the opposite side of the security lock relative to FIG. 4, is taken along line 6—6 in FIG. 5, and shows the elongate movable abutment member in dotted line when the same is removed from its abutment position relative to the door, whereby to allow the door to swing inwardly so as to permit the device to be released from the door jam.
Figure 7:
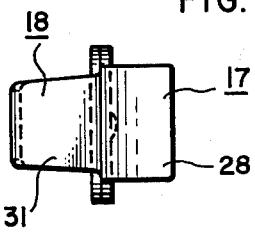
FIG. 7 is an end view and is taken along the line 2—7 in FIG. 6.

It is to be noted in the operation of the security lock 16 herein that the elongate catch member 17 is first positioned in place, prior to door closure, with the movable abutment member 18 disposed in its extended condition as is shown, for example, at 18 in FIG. 6 at the dotted line condition thereof. Subsequently, the door is closed and the movable abutment member 18 is pivoted about axis A so that the entire lock member 16 assumes the condition shown in FIG. 4. At this point the safety lock is fully operative to prevent a person from opening the door, surreptitiously or otherwise, in the usual direction, see arrow B, FIG. 2.

What is provided, therefore, is a new and improved safety lock in the form of lock member 16, shown as a padlock in FIG. 3, which is useful as a portable temporary security lock for conveniently locking doors even though a key or other means is not employed. This is accomplished through the engagement of the catch member 17, at foot portion 28 with the reaction surface 28A of jam latch locket 29 or strike plate 30, and with an associated member, namely, movable abutment member 18, being turned inwardly as seen in FIG. 2 such that the abutment foot 31 is disposed in close proximity with or is actually touching the rear surface 33 of the door.

If desired, and where close tolerances are relatively assured, the security lock herein may be designed so that foot portion 31 exactly engages rear surface 33 of foot 10. Usually there is sufficient play as between the latch and latch socket or strike plate to allow for the pivoting of member 18 even though the forward surface of foot portion 31 is completely flat; of course, a slight convex outer curvature may be given to such foot portion at its outer door-engaging surface to allow for the selective pivoting of member 18 relative to member 17. In the usual condition, however, and owing to rather liberal tolerances in door-latching constructions, the door-engaging region of foot portion 31 may be completely flat as shown. In addition, and if desired, a key chain or other means may be disposed through pivot, eyelet rivet 21, see chain 36 in FIG. 6.

Figure 8:
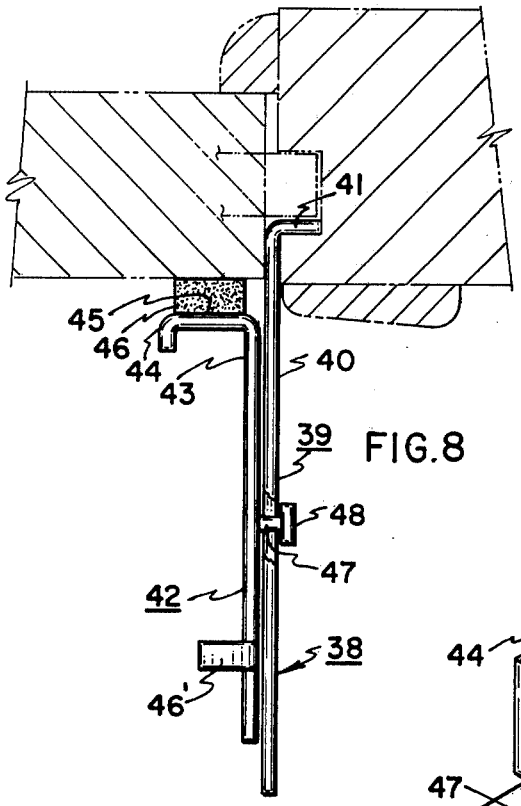
FIG. 8 is a top plan of an alternate and preferred form of the invention, and roughly corresponds to the top plan of FIG. 2.
Figure 9:
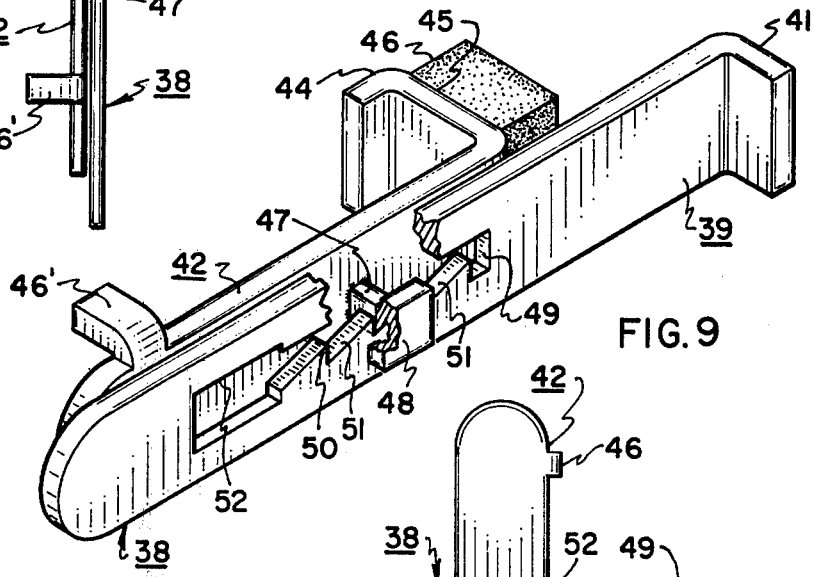
FIG. 9 is a perspective, partially broken away view of the structure of FIG. 8, this illustrating the co-action of the dog of the movable abutment member with the ratchet-teeth and notches of the elongate catch member.
Figure 10:
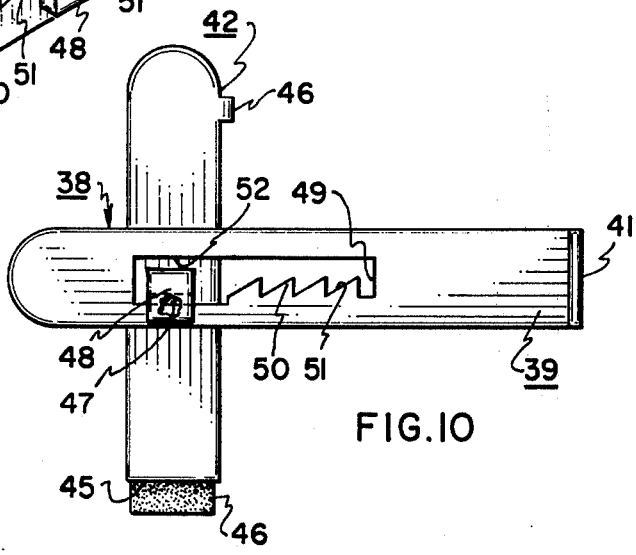
FIG. 10 is similar to FIG. 9 but illustrates the movable abutment member as having been released from the door and the former drops downwardly so that the door may be opened.

In FIGS. 8–10, a preferred embodiment of the invention, lock member 38 includes an elongate catch member 39, the same comprising elongate portion 40 and foot portion 41 contiguous therewith. Movable abutment member 42 comprises an elongate portion 43 and a foot abutment portion 44 contiguous therewith. Cemented or otherwise adhered to outer surface 45 of foot abutment portion 44 is a resilient pad 46 made of Neoprene, rubber, or a suitable material of similar character. Movable abutment member 42 includes, as well, a lateral tab 46' for finger manipulation and, additionally, a dog 47 having an enlarged end such as a raised ear at 48. The dog 47 fits in slot 49 provided the elongate catch member 39. Slot 49 includes a series of teeth 50 defining detent notches 51 for the reception of suitably configured dog 47. In the latter regard, the dog may have a sloping undersurface to exactly fit into a particular selected notch 51. Enlarged end 48 keeps the dog within slot 49 and, in any event, prevents the inadvertent disengagement of movable abutment member 42 from elongate catch member 39.

A pivot aperture 52 is provided and is contiguous with slot 49. The purpose for the inclusion of pivot aperture 52 is so that the movable abutment member 42 may freely drop downwardly when the same is retrieved rearwardly from its forward engagement position with respect to a closed door.

In operation, the structure shown in FIG. 8 illustrates a movable abutment member as having been advanced forwardly once the foot portion 41 is in place in a manner similar to that described in connection with foot portion 28 in FIG. 2 of the first embodiment disclosed. The dog and teeth co-action provide for a rough positionment of the movable abutment member 42 relative to elongate catch member 39, the resilient pad 46 taking up the slack and providing a sure and complete closure of the door against the jam stop for all nominal door dimensions thicknesswise and slight deviations therefrom. Accordingly, one pushes forwardly on the movable abutment member and then drops the dog down to an appropriate notch 51 so that the engagement can be held. It is noted that the same is secured and cannot be jiggled free from the outside.

When the user determines to release the lock, he merely raises upwardly, appropriately, on the movable abutment member 42 so that the pad 46 is removed from its abutting engagement with the door and hence, once the dog 47 is retrieved rearwardly to be positioned in pivot aperture 52, the movable abutment member 42 can simply drop downwardly to the position shown in FIG. 10, thereby allowing for a free door opening and subsequent removal of the security lock.

It is noted that the construction of this second embodiment is such that rounded cams, corner chipping and other disadvantages and malfunctions are avoided in structures as are conventional and which do not use the resilient pad 46 in combination with the detent structure shown as per slot 49 and dog 47. Enlarged end 48 simply keeps the two members 42 and 39 from becoming disengaged.

As to the second embodiment, while the construction shown in FIGS. 8–10 is preferred, the dog 47 being either slant from or rigidly secured as a separate part to abutment member 42, yet the dog or pin 47 and the slot 49 can be disposed in the opposite, respective elongate members.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A portable security lock for doors, their latches and latch sockets, including, in combination: first and second individually unitary elongate members mutually disposed in slidable engagement, said elongate members having oppositely and laterally extending forward foot portions, one of said foot portions having adhered thereto a fixed, forwardly facing, resilient abutment pad means for rearwardly biasing said one foot portion and its elongate member when said pad means engages an external, closed door, one of said elongate members being provided with an elongate slot having a series of detent notches, the remaining elongate member having a laterally extending dog slideably disposed in said slot and constructed to be releasably disposed in and, by virtue of said resilient paid means, resiliently pressed against a side of a respective one of said notches, that elongate member provided said resilient pad means having an integral lateral finger tab, and means for securing said elongate members together.

2. The structure of claim 1 wherein said securing means comprises an elongate member retention abutment contiguous with said dog.

3. The structure of claim 1 wherein said elongate members are provided with means for relesably securing them in mutually aligned disposition.

4. The structure of claim 1 wherein said resilient pad means is disposed rearwardly of said foot portion of the remaining elongate member.

* * * * *